US009675824B2

(12) United States Patent
MacKarvich

(10) Patent No.: US 9,675,824 B2
(45) Date of Patent: Jun. 13, 2017

(54) FALL RESCUE APPARATUS

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 70 days.

(21) Appl. No.: 14/712,305

(22) Filed: May 14, 2015

(65) Prior Publication Data

US 2016/0332011 A1 Nov. 17, 2016

(51) Int. Cl.
*A62B 35/00* (2006.01)

(52) U.S. Cl.
CPC ..... *A62B 35/0068* (2013.01)

(58) Field of Classification Search
CPC ..... A62B 35/0068; E04G 21/3261
See application file for complete search history.

(56) References Cited

U.S. PATENT DOCUMENTS 4,274,507 A 6/1981 Williams
4,496,027 A 1/1985 Fisher
4,607,724 A * 8/1986 Hillberg ..... E04G 21/3261 182/3
4,817,758 A 4/1989 Gilmore
5,004,072 A 4/1991 Launer
5,135,078 A 8/1992 Bell et al.
5,328,192 A 7/1994 Thompson
5,337,856 A 8/1994 Fillers
5,370,203 A 12/1994 Kiska
5,476,282 A 12/1995 Dahl
5,820,143 A 10/1998 Rigo
6,019,330 A 2/2000 Affrunti
6,227,553 B1 * 5/2001 Palmer ..... A62B 35/0068 182/13
6,412,230 B1 7/2002 Zambelli et al.
6,786,020 B2 * 9/2004 Poldmaa ..... A62B 35/0068 182/45
6,805,220 B2 10/2004 Fulton et al.
6,880,838 B2 4/2005 Hjorth
7,032,710 B2 4/2006 Anderson et al.
7,207,414 B2 * 4/2007 Luke ..... A62B 35/0056 182/3
7,537,085 B2 5/2009 Vetesnik
8,240,431 B2 8/2012 Smith
8,312,680 B2 11/2012 Krahn et al.
2007/0289811 A1 * 12/2007 Smith ..... A62B 35/04 182/3
2009/0321184 A1 * 12/2009 Hamilton ..... A62B 99/00 182/3
2011/0303484 A1 * 12/2011 Stoffels ..... A62B 99/00 182/3
2013/0264442 A1 * 10/2013 Correia ..... A62B 35/0068 248/205.1

* cited by examiner

*Primary Examiner* — Alvin Chin-Shue
*Assistant Examiner* — Candace L Bradford
(74) *Attorney, Agent, or Firm* — Thomas|Horstemeyer LLP

(57) ABSTRACT

A fall rescue apparatus (10) for mounting on the roof of a building includes a spike (28) mounted to an extendable support arm (27) and shaped to penetrate the roof in response to the pull of a tether (35) connected to a falling worker. An elbow linkage (39) unfolds as the spike is extended into the roof for guiding and supporting the spike against the roof.

12 Claims, 6 Drawing Sheets

FALL RESCUE APPARATUS

FIELD OF THE INVENTION

This invention concerns a fall rescue apparatus for catching a person falling from the edge of a roof of a building structure, and from other elevated structures.

In a typical situation, roof installers and roof repair workers work in a hazardous condition and are required to move about roofs while removing and retrieving roofing materials and installing the materials on the support surfaces of the roof. The work is hazardous, particularly after the roofers have worked for an extended time on the roof. Also atmospheric conditions such as heat, cold, wind, humidity and other physical conditions of the environment may be undesirable during the work hours. It is desirable to reduce the hazards of a roofer, particularly from falling from the roof.

Prior art rescue devices have been developed that workers use to attach a safety cable or "tether" between themselves and the rescue apparatus on the roof structure. This invention provides a more secure and more effective fall rescue apparatus that allows the worker to move about a roof surface.

SUMMARY OF THE INVENTION

Briefly described, the present invention concerns a fall rescue apparatus for mounting on a roof of a building or on another elevated structure. The apparatus includes a support frame for mounting on the elevated surface at the edge of the elevated surface. A rectilinear guide member is mounted to the support frame and is sloped downwardly from the support frame toward the elevated surface of the building structure, toward an adjacent edge of the elevated surface. An extendable support arm is movably mounted to the rectilinear guide member and is movable in a downward sloped direction toward the elevated roof surface, and a spike is mounted to the end of the extendable support arm. The spike is shaped to penetrate the elevated roof surface in response to the downward movement of the extendable support arm. And a tether, having one end connected to a worker and connected at its other end to the spike, is used for pulling the spike and the extendable support arm toward the elevated roof surface to penetrate the roof structure and resist the fall of the worker.

The extendable support arm may be telescopically mounted to the rectilinear guide member and the spike may be rigidly mounted to the extendable support arm.

An elbow linkage is connected between the support frame and the spike so that, as the spike is extended from the support frame, the elbow linkage moves from a folded configuration to an elongated configuration. When the elbow linkage is in its elongated configuration it tends to apply the weight of the support frame to the spike so that the spike has a more rigid connection to the support frame and uses the weight of the support frame to penetrate the roof structure.

The spike may be approximately "C-shaped" with upper and lower extensions, with the upper extension comprising a handle for connection to the tether and a lower extension comprising a sharpened probe for engagement with the roof of the building. If the worker that is connected to the tether falls from the roof, tension force is applied to the tether and is transmitted by the tether to the upper extension of the C-shaped spike, tending to pull the spike from the support frame and as the spike is pulled by the tether, its lower sharpened extension tends to penetrate the roof.

Other objects, features and advantages of the present invention will become apparent upon reading the following specification, when taken in conjunction with the accompanying drawings, as set forth hereinafter.

DETAILED DESCRIPTION

Figure 1:
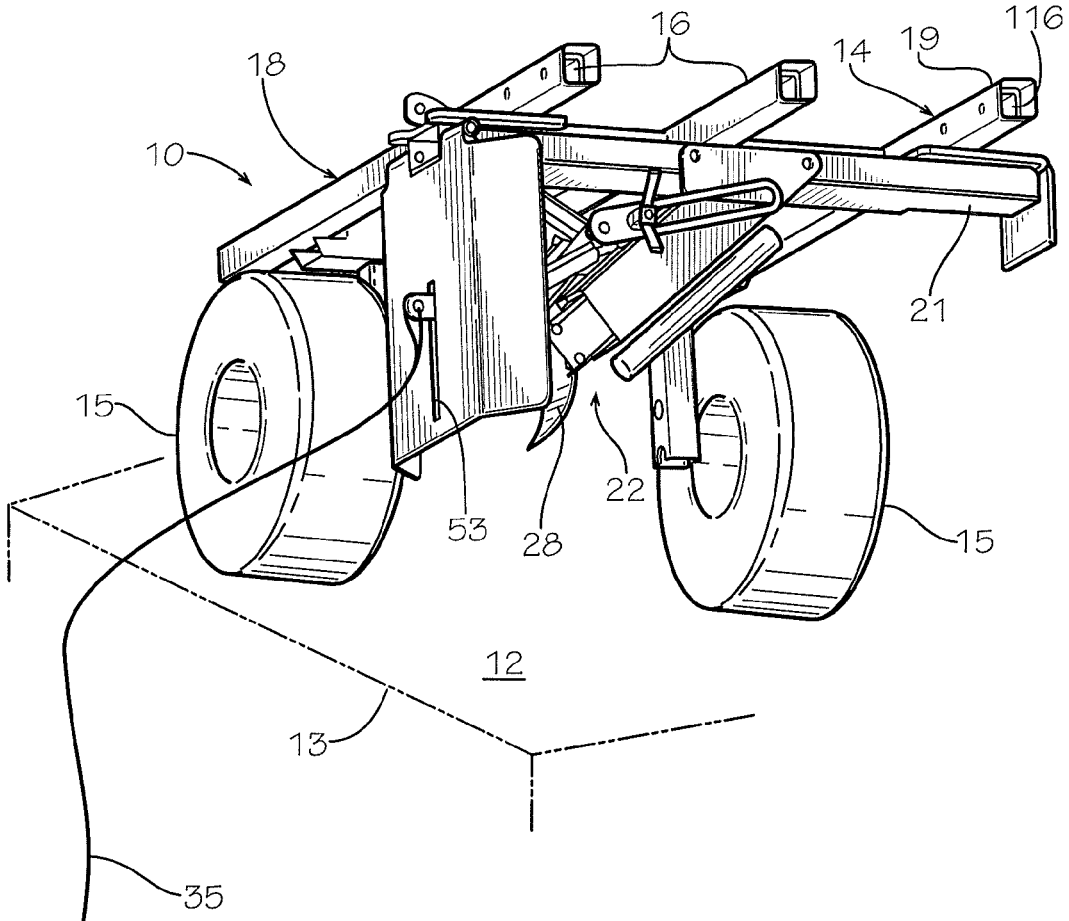
FIG. 1 is a perspective view of a rear segment of a movable support structure, taken along lines 1-1 of FIG. 2 and showing the fall rescue apparatus mounted thereon.
Figure 2:
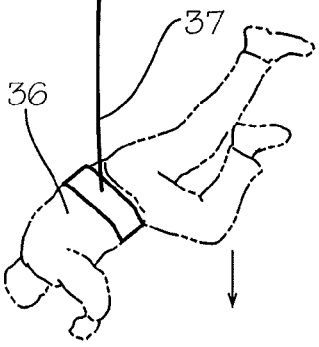
FIG. 2 is a perspective view of a wagon that functions as the support structure for the fall rescue apparatus.
Figure 2:
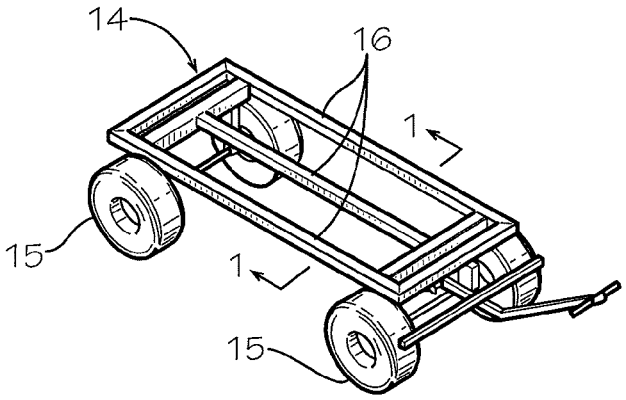

Referring now in more detail to the drawings, in which like numerals indicate like parts throughout the several views, FIG. 1 illustrates a fall rescue apparatus 10 that is mounted on the surface 12 of a roof structure. The fall rescue apparatus includes a support, such as the mobile support frame 14 of FIG. 2, in the form of a wagon having soft, air inflated wheels 15 that support the longitudinal, parallel support bars 16. The mobile support frame 14 becomes the means for supporting the rest of the fall rescue apparatus, which includes a horizontal support frame 18 mounted to the longitudinal support bars 16 of the mobile support frame 14.

Lateral beam 21 is suspended from the longitudinal box beams 19 and functions to support the extendable spike assembly 22 that is suspended between the front and rear wheels 15 of the mobile support frame 14. A rectilinear guide member 24 is mounted at one end to support bracket 25, spike support arm 27 is movable longitudinally through the rectilinear guide member 24, and spike 28 is mounted to spike support arm 27. The rectilinear guide member 24 may be in the form of an elongated tube, and the spike support arm 27 may be in the form of a bar that is telescopically mounted in the tube. Spike 28 may be rigidly mounted to the extendable support arm by bolts 29.

Figure 4:
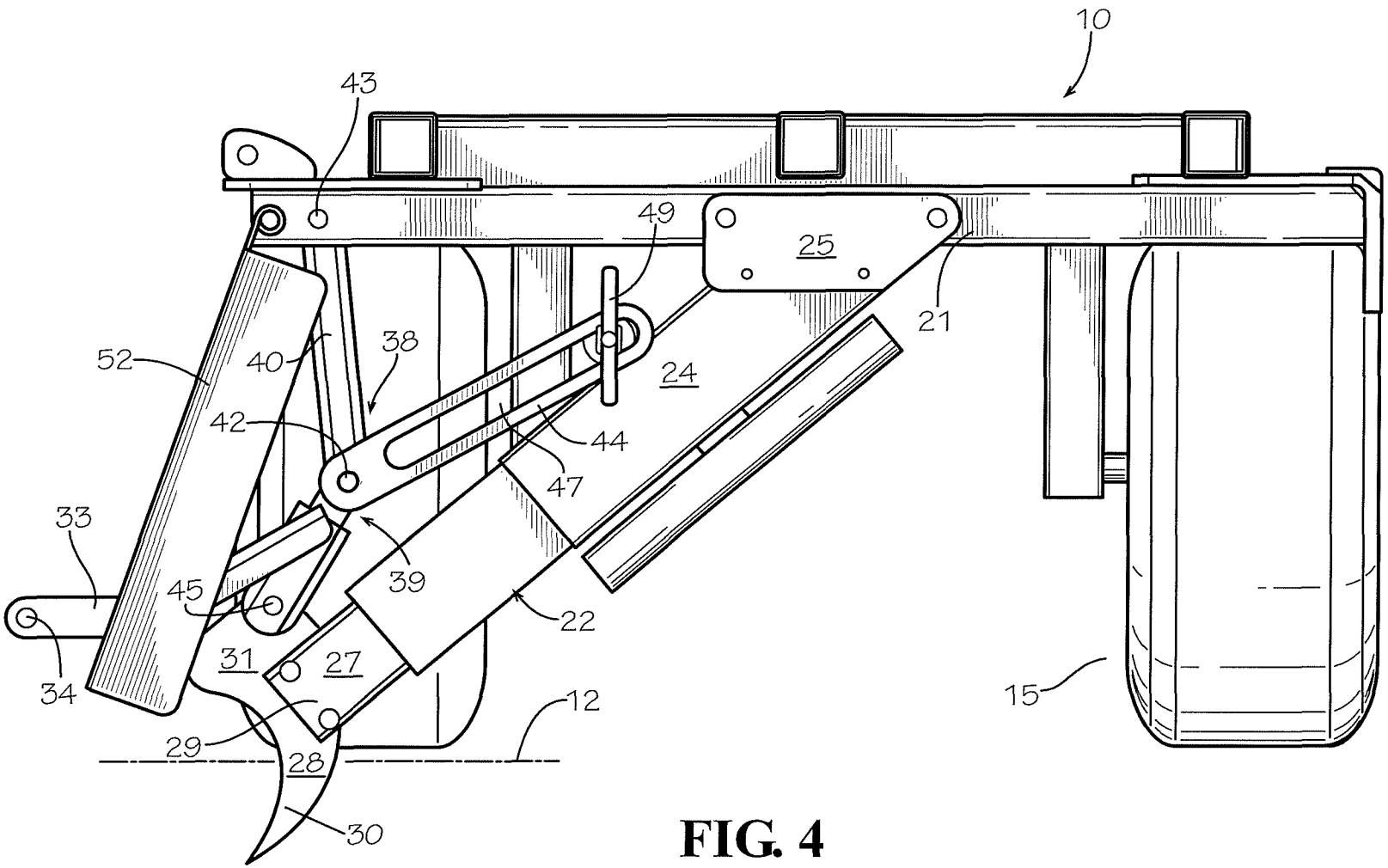
FIG. 4 is a front elevational view of the fall rescue apparatus, similar to FIG. 3 but showing the spike extended from its support frame in a sloped downward direction for penetration into the surface of the roof structure.

As best shown in FIG. 4, spike 28 is approximately C-shaped, including a pointed lower end 30 for facing toward the roof surface and the edge 13 of the roof, and an upper end 31 of larger width. A lever 33 extends from the upper end of the spike 28 and the lever includes an opening 34 for connection to a tether 35. The distal end 37 of the tether is to be connected to a roof worker 36, shown in FIG. 1 as if falling from the roof structure.

Figure 3:
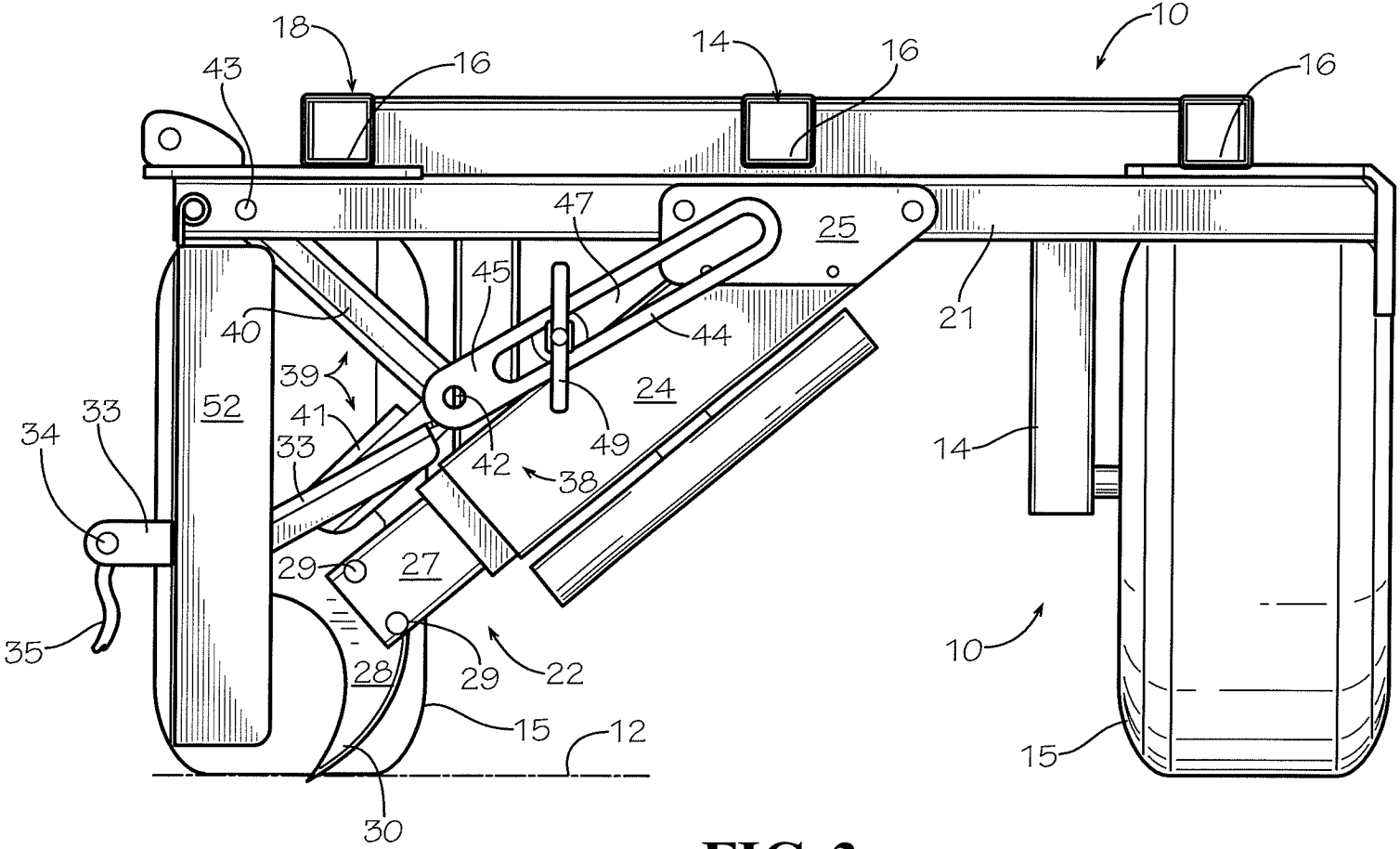
FIG. 3 is a front elevational view of the fall rescue apparatus, showing the spike in its retracted position suspended from the support frame above the roof surface.

Spike control linkage 38 is shown in FIG. 3 with the spike retracted, and in FIG. 4 with the spike extended. An elbow linkage 39 is mounted between the lateral beam 21 and the spike 28. The elbow linkage includes an upper elbow arm 40 and lower elbow arm 41. The upper elbow arm 40 is connected at its upper end by pivot pin 43 to the lateral beam 21 and at its lower end to the elbow pivot pin 42.

Lower elbow arm is also connected to the elbow pivot pin 42, and at its lower end by pivot pin 45 to spike 28. Elbow linkage control arm 44 has its lower end connected to the elbow pivot pin 42. The elbow linkage control arm 44 includes an interior, elongated slot 47 that moves longitudinally about clamp 49 that is mounted to rectilinear guide member 24. When the clamp 49 is tightened, it holds the elbow linkage 39 in its static position.

Figure 6:
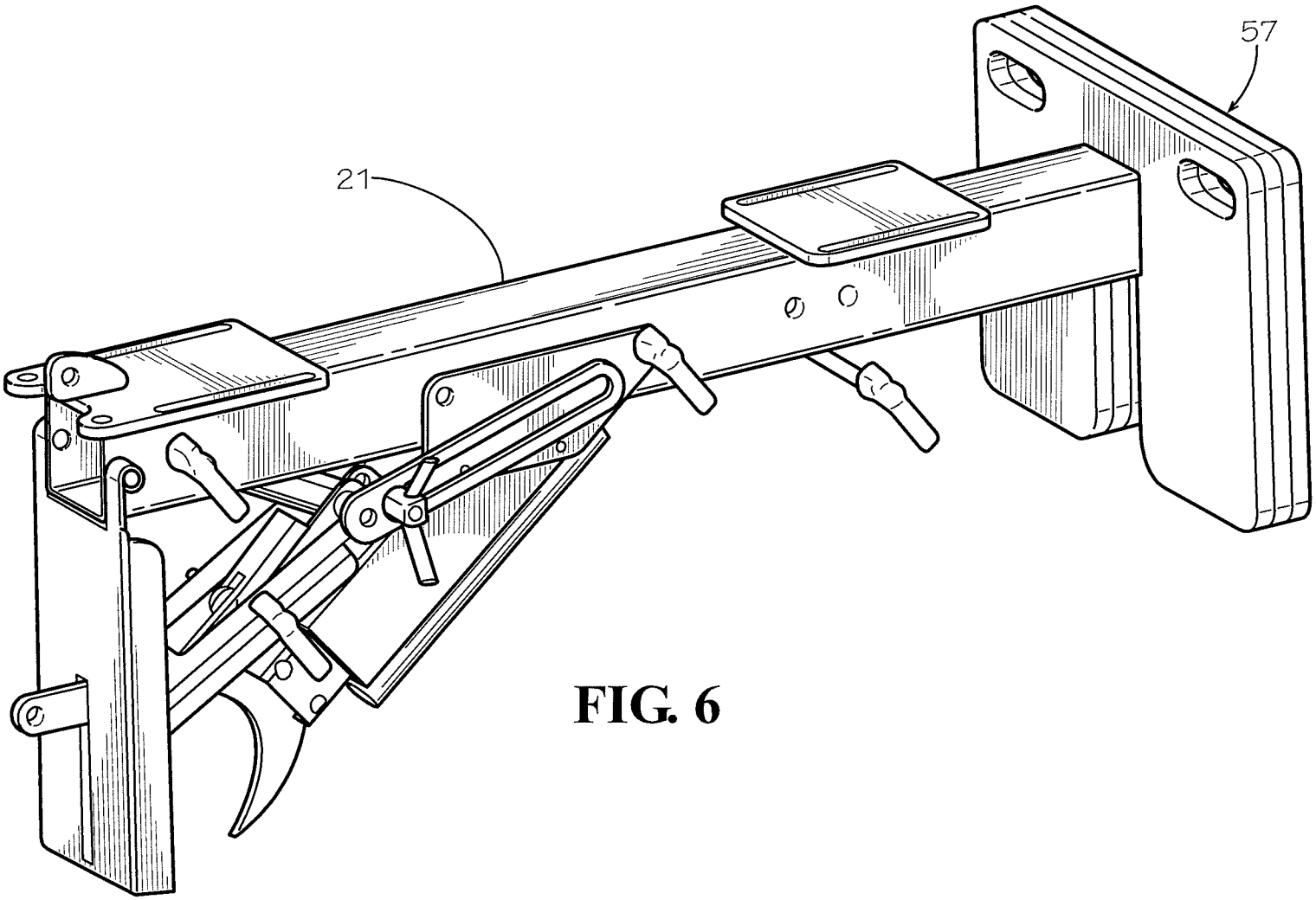
FIGS. 6 and 7 are perspective views of the counterweight mounted to the lateral beam of the fall rescue device, with FIG. 6 showing the counterweights in the retracted position and FIG. 7 showing the counter weights in the extended position.
Figure 7:
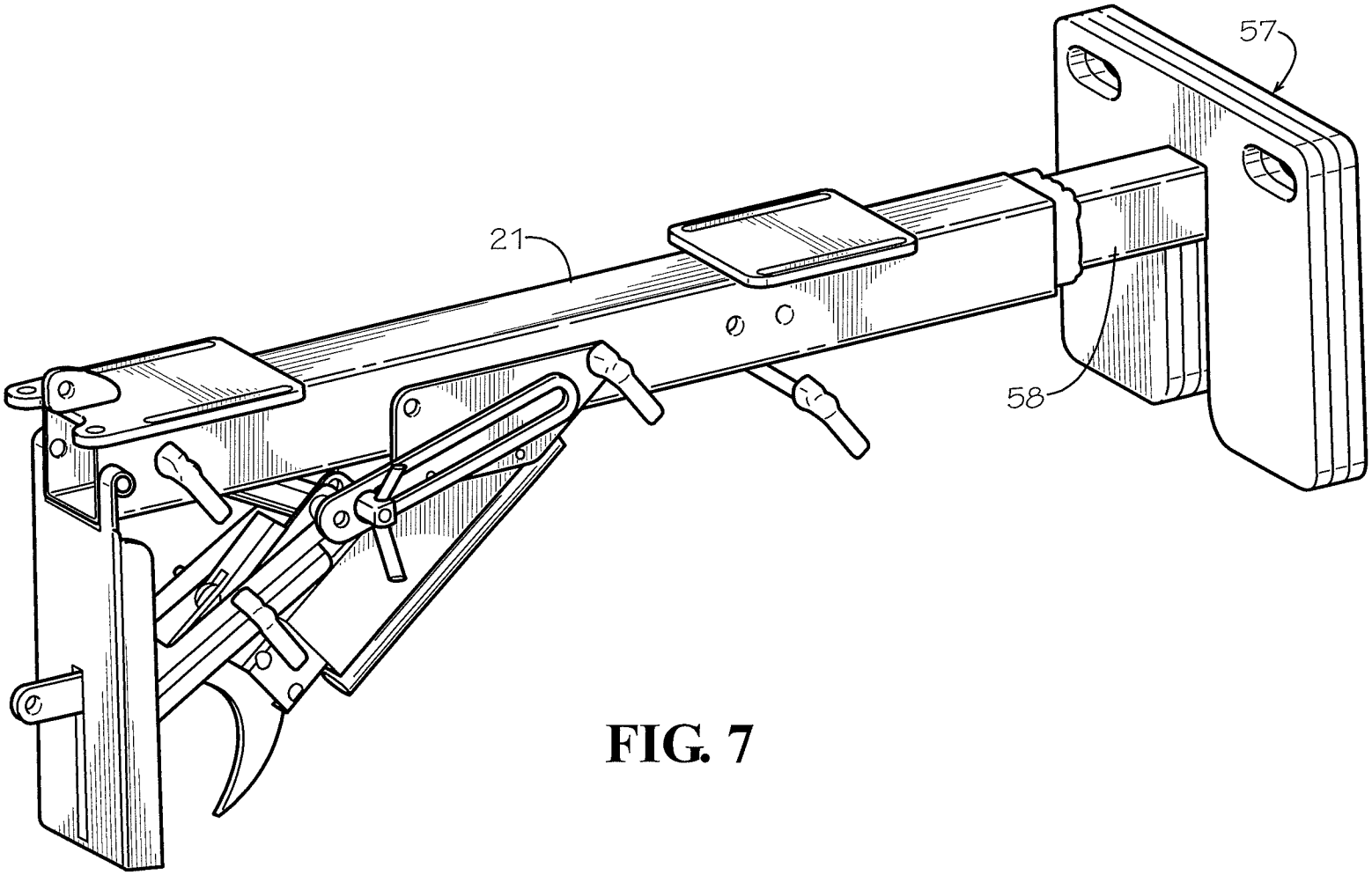

As shown in FIGS. 6 and 7, a counter balance structure 57 may be added to the lateral beam 21 to apply weight to the side of the fall rescue apparatus that is positioned away from the spike 28. The counter weight structure includes a support beam 58 that has one end portion telescopically inserted into the lateral beam 21. A plurality of U-shaped counter weights are mounted on the distal end (not shown) of the support beam 58. The extra weight helps to avoid tipping of the rescue apparatus, and when the spike 28 moves toward penetration of the roof surface the extra weight helps to avoid tipping of the assembled rescue apparatus and may add to the force applied to the spike 28 as the it penetrates the roof.

The support beam 58 may be retracted when the U-shaped counter weights are removed so the weight of the rescue apparatus is lighter and easier to install and remove from the building structure.

OPERATION

When the fall rescue apparatus as shown in FIG. 3 is moved on a roof structure to a location where its spike 28 faces the edge 13 of the roof 12. The spike 28 will face the edge of the roof structure over which the worker 36 (FIG. 1) is to perform his work projects. A tether 35 is extended through the opening 34 of the lever 33 of the spike, with the worker to be connected at the other end of the tether.

When the fall rescue apparatus is at rest, the spike 28 and its lever 33 will be retracted as shown in FIG. 3, with the spike extendable bar 27 retracted into its rectilinear guide member 24. The elbow linkage 39 is folded as shown in FIG. 3, with the elbow linkage control arm 44 retracted about its clamp 49. This pulls the elbow linkage 39 into its folded position as a shown in FIG. 3, with the spike retracted.

When the worker 36 connects himself to the tether 35, the clamp 49 of the elbow linkage control arm 44 is loosened so that the control arm 44 can move about the clamp 49, and the elbow linkage 39 can unfold from its folded position in FIG. 3 to its more longitudinal position as shown in FIG. 4.

It will be noted that as the tether 35 pulls spike lever 33, the spike moves at approximately a 45° angle downwardly into the roof 12, illustrated by comparison of FIGS. 3 and 4 of the drawings.

As the spike moves from FIG. 3 position to FIG. 4 position, the elbow linkage 39 unfolds from its folded position in FIG. 3 to its extended position in FIG. 4. As the elbow linkage unfolds toward its more rectilinear configuration, it tends to more aggressively limit the rearward movement of the spike 28, tending to further thrust the pointed lower end 30 of the spike into the surface of the roof structure 12.

As shown in FIGS. 3 and 4, fender 52 is pivotally mounted at its upper end to the lateral beam 21 and is suspended down from the frame, toward the roof structure 12 as shown in FIG. 3. The fender includes a slot 53 (FIGS. 1 and 5) and the lever 33 of the spike 28 extends through the slot so that the fender is positioned to shield the spike 28 from contact with a worker or other obstructions. When the tether 35 is pulled, as by a falling worker, the tether pulls the lever 33 which, in turn, pulls the spike 28, and the spike is guided at a downwardly sloped acute angle directed into the surface of the roof structure 12.

Figure 5:
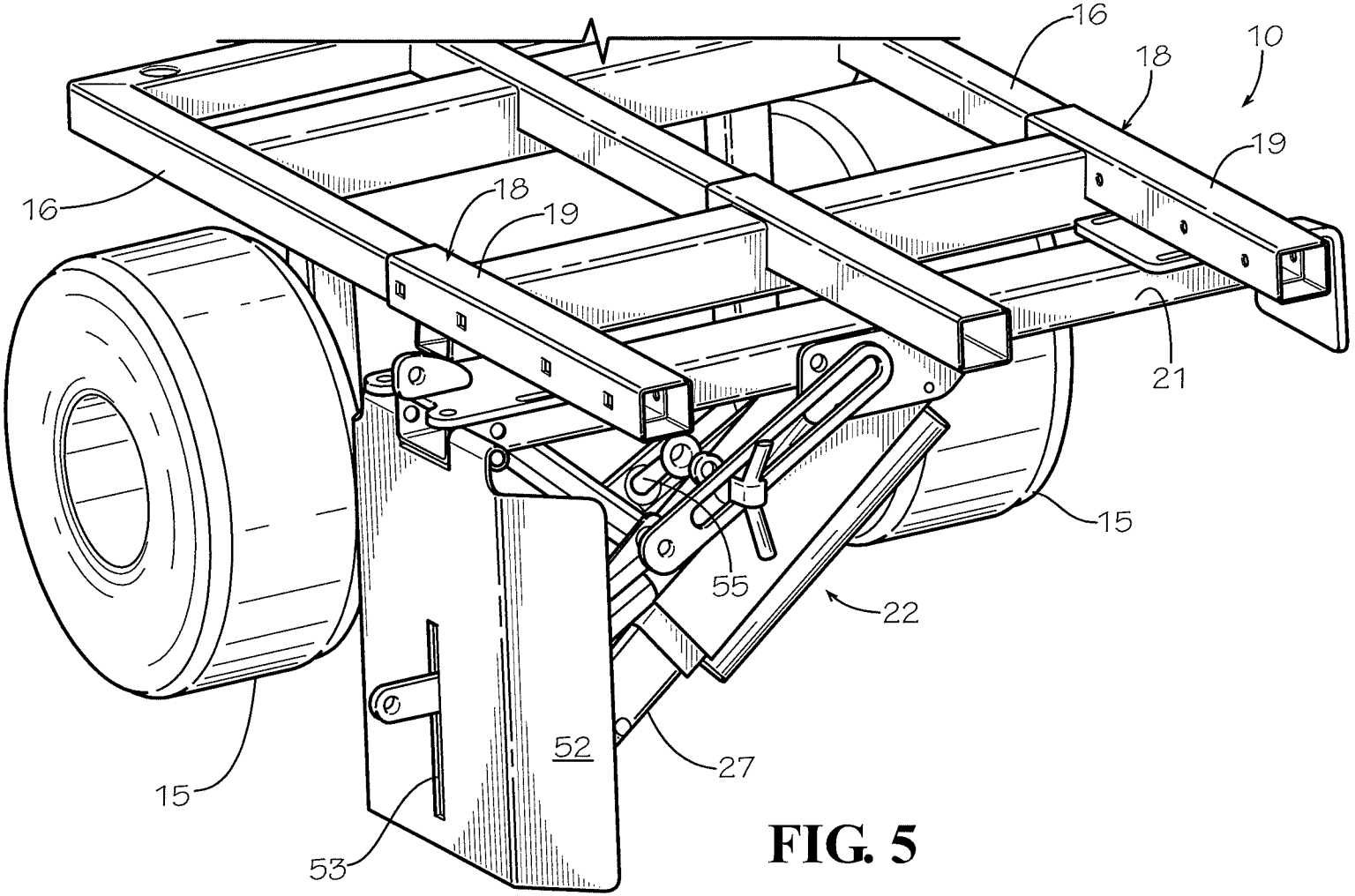
FIG. 5 is a perspective view, showing the front and one side of the fall rescue apparatus.

When the fall rescue apparatus 10 is to be transported, the spike 28 will be pushed back from its extended position of FIG. 4 into its retracted position as shown in FIGS. 3 and 5, with its spike support arm moved back into the tubular guide member 24. As the spike is retracted, the elbow linkage 39 bends about the elbow pivot pin 42, changing its configuration from the extended configuration of FIG. 4 back to the folded configuration of FIG. 3. As the elbow linkage folds, its control arm 44 tends to slide about the clamp 49. The elbow linkage control arm includes a detent 55 (FIG. 5). When the end of the slot 47 at the elbow pivot pin 42 reaches the clamp 49 the clamp can be tightened to pull detent 55 into registration with the clamp, thereby locking the spike 28 in its retracted, portable position.

When the fall rescue apparatus reaches its next destination on a rooftop, the clamp 49 may be loosened so that the spike is functional to move in its downward sloped direction for engagement with the rooftop in response to the pull of the tether 35.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. A fall rescue apparatus comprising:

a support frame for mounting on an elevated structure adjacent an edge of the elevated structure, a rectilinear guide member mounted to the support frame and sloped downwardly from the support frame toward the elevated structure adjacent the edge of the elevated structure, an extendable support arm movably mounted to the rectilinear guide member and movable parallel to the rectilinear guide member toward the elevated structure, a spike mounted to the extendable support arm shaped to penetrate the elevated surface in response to the parallel movement of the extendable support arm, a tether connected to the spike for pulling the spike and the extendable support arm toward the elevated surface, an elbow linkage connected to the spike and the support frame, the elbow linkage including an upper elbow arm with an upper end pivotally mounted to said support frame and an upper arm elbow end, a lower arm including an elbow end pivotally mounted to the elbow end of the upper arm and a distal end pivotally mounted to the spike, a locking arm including a distal end mounted to the elbow ends of both the upper arm and lower arm and movable in unison with the elbow ends of both the upper arm and lower arm, and an upper end portion extending away from the elbow end, and a lock member engageable with the upper end portion of the locking arm for maintaining the spike withdrawn from penetrating the elevated structure.

2. The fall rescue apparatus of claim 1, wherein the extendable support arm is telescopically mounted to the rectilinear guide member, and the spike is rigidly mounted to the extendable support arm.

3. The fall rescue apparatus of claim 1, wherein the locking arm defines a slot, and said lock member includes a bolt mounted to the rectilinear guide member and the bolt extends through the slot.

4. The fall rescue apparatus of claim 1, wherein said spike is crescent shaped with a pointed end for facing toward the edge of the elevated structure.

5. The fall rescue apparatus of claim 4, and further including a shield facing said spike, the shield defining a slot and said spike including a lever extending through the slot for attachment to the tether for connection to a person working on the elevated surface.

6. A fall rescue apparatus for catching a person falling from a roof of a building comprising:

a support frame for resting on the roof of the building, a spike movably mounted on the support frame, the spike having a pointed end facing away from the support frame for extending toward the edge of the roof of the building, a tether having a distal end for connection to a person on the roof of the building and a proximal end connected to the spike for drawing the spike away from the support frame into the roof of the building at a position between the support frame and the edge of the roof of the building in response to the person falling off the roof of the building, an elbow linkage connected between the spike and the support frame, the elbow linkage including an upper arm with an upper end pivotally mounted to said support frame and an upper arm elbow end, a lower arm including an elbow end pivotally mounted to the elbow end of the upper arm and a distal end pivotally mounted to the spike, a locking arm including a distal end mounted to the elbow ends of both the upper arm and lower arm and movable in unison with the elbow ends of both the upper arm and lower arm, and an upper end portion extending away from the elbow end, and a lock member releasably engageable with the upper end of the locking arm for maintaining the spike withdrawn from penetrating the elevated surface.

7. The fall rescue apparatus of claim 6, and further including a telescopic support for maintaining the spike in the support frame and expandable to move the spike into the roof.

8. The fall rescue apparatus of claim 6, and further including an elbow linkage mounted between the spike and the support frame for resisting withdrawal of the spike from the roof.

9. The fall rescue apparatus of claim 6, wherein the spike is C-shaped with upper and lower extensions, with the upper extension comprising a lever for connection to the tether and a lower extension comprising a sharpened probe for engagement with the roof of a building.

10. The fall rescue apparatus of claim 9, and further including a fender defining an opening there through, and the lever of the C-shaped spike extending through the opening and the sharpened probe moves below the fender.

11. A fall rescue apparatus for catching a person falling from a roof of a building comprising:

a support frame for resting on the roof of the building, a spike movably mounted on the support frame, the spike having a pointed end facing away from the support frame for extending toward the edge of the roof of the building, a tether having a distal end for connection to a person on the roof of the building and a proximal end for connection to the spike for drawing the spike away from the support frame toward the roof of the building in response to the person falling away from the support frame, an elbow linkage connected between the spike and the support frame, the elbow linkage including an upper arm with an upper end pivotally mounted to said support frame and an upper arm elbow end, a lower arm including an elbow end pivotally mounted to the elbow end of the upper arm and a distal end pivotally mounted to the spike, a locking arm including a distal end mounted to the elbow ends of both the upper arm and lower arm and movable in unison with the elbow ends of both the upper arm and lower arms, and an upper end portion extending away from the elbow end, and a lock member releasably engageable with the upper end of the locking arm for maintaining the spike withdrawn from penetrating the elevated surface.

12. The fall rescue apparatus of claim 6, wherein the locking arm defines a slot, and the lock member extends through the slot.

* * * * *